United States Patent [19]

Ooyabu et al.

[11] Patent Number: 4,653,460

[45] Date of Patent: Mar. 31, 1987

[54] IGNITION SYSTEM FOR INTERNAL COMBUSTION ENGINES

[75] Inventors: Shinji Ooyabu, Obu; Kazuo Suzuki, Okazaki; Masahiro Kondo, Toyohashi; Hirotoshi Nakamura, Kariya, all of Japan

[73] Assignee: Nippondenso Co., Ltd., Kariya, Japan

[21] Appl. No.: 756,943

[22] Filed: Jul. 19, 1985

[30] Foreign Application Priority Data

Jul. 26, 1984 [JP] Japan ..... 59-156670

[51] Int. Cl.[4] ..... F02P 3/04

[52] U.S. Cl. ..... 123/645; 123/643; 123/655

[58] Field of Search ..... 123/655, 656, 645, 643, 123/640; 315/209 M, 213

[56] References Cited

U.S. PATENT DOCUMENTS 4,103,659 8/1978 Donigian ..... 123/656
4,109,631 8/1978 Miyao ..... 123/643
4,361,129 11/1982 Sugie et al. ..... 123/622
4,411,247 10/1983 Kunita et al. ..... 123/655
4,463,744 8/1984 Tanaka et al. ..... 123/655

FOREIGN PATENT DOCUMENTS 55-66659 5/1980 Japan .

*Primary Examiner*—Andrew M. Dolinar
*Attorney, Agent, or Firm*—Cushman, Darby & Cushman

[57] ABSTRACT

In an ignition system for an internal combustion engine which is operable in synchronism with rotation of the engine to switch on and off a primary current in an ignition coil and applies to a spark plug a high voltage induced in the ignition coil secondary winding upon the off switching, a Zener diode is connected to the low-voltage side of the ignition coil secondary winding in order to prevent a secondary voltage induced upon the on switching of the primary current from being applied to the spark plug.

9 Claims, 13 Drawing Figures

IGNITION SYSTEM FOR INTERNAL COMBUSTION ENGINES

BACKGROUND OF THE INVENTION

The present invention relates to an ignition system for internal combustion engines.

In one of conventional ignition systems of this type, such as disclosed in Japanese Laid-Open Patent Publication No. 55-66659, an energy is stored in the primary winding of an ignition coil by the battery voltage and a power transistor is turned on and off by a switching signal thus producing a high voltage across the secondary winding of the ignition coil. A spark is thereby produced at a spark plug through a high-voltage rectifier diode connected to the high-voltage side of the secondary winding.

Then, the current flowing in the primary winding becomes as shown in FIG. 3A and the voltage induced across the secondary winding becomes as shown in FIG. 3B. In this case, the spark plug discharge at a transistor OFF point b shown in FIG. 3A and at this time the ignition coil secondary voltage becomes as shown in FIG. 3C. Also, at this time the discharge current becomes as shown in FIG. 3D. Primarily, the voltage induced in the ignition coil corresponds to a variation of the primary current. Thus, while the voltage for causing the spark plug to discharge is primarily induced at the transistor OFF point b shown in FIG. 3A, a secondary voltage is also induced at a transistor ON point a. This voltage (about 2 KV) corresponds to the ON voltage shown in FIG. 3B. In the conventional ignition system of the distributor-connected type, an idle spark is produced by the distributor high-voltage distributing operation and thus the spark plug is prevented from being fired by the ON voltage. However, in the case of a direct connected-type ignition coil where a spark plug is directly connected to the secondary winding of the ignition coil, no idle spark is produced and there is ample possibility of causing any firing when the transistor is turned on. This causes an engine trouble. As shown in FIG. 3C, this ON voltage is opposite in polarity to the high voltage primarily required for producing the plug spark discharge. Thus, if the high-voltage rectifier diode is connected just before the spark plug, the ON voltage produced at the cathode of the high-voltage rectifier diode no longer appears at the anode of the highvoltage rectifier diode so that there occurs no discharge due to the turning-on of the transistor.

In this type, however, the diode is connected on the high-voltage side between the secondary winding and the spark plug thus giving rise to such problems as breaking down of the high-voltage diode by such capacitive discharge current as shown in FIG. 3D and deterioration of the high-voltage diode due to the discharge producing high voltage.

SUMMARY OF THE INVENTION

It is therefore an object of the present invention to provide an improved ignition system for an internal combustion engine so arranged to prevent the occurrence of the plug firing due to the secondary high voltage induced upon the flow of a primary current through the ignition coil and to avoid otherwise possible destroy of such a diode due to a capacitive discharge current and any deterioration of the diode due to the high voltage.

It is another object of the invention to provide an ignition system for an internal combustion engine including switching means adapted to open and close in synchronism with the rotation of the engine, an ignition coil whose primary current is switched on and off in response to the opening and closing of the switching means, a spark plug connected to a secondary winding of the ignition coil such that an ignition spark is produced at the spark plug by a high voltage induced in the secondary winding of the ignition coil when the switching means is opened, and a Zener diode connected to a secondary winding low voltage side of the ignition coil.

Thus, due to the connection of the Zener diode to the low voltage side, no ill effect is caused by the capacitance distributed in the secondary winding of the ignition coil and there is no danger of the application of a high voltage to the diode during the period of normal ignition. Moreover, when the open voltage of the spark plug is applied to the Zener diode, the Zener diode is turned on so that the reverse voltage applied to the Zener diode is reduced to a low value.

DESCRIPTION OF THE PREFERRED EMBODIMENTS

Figure 1:
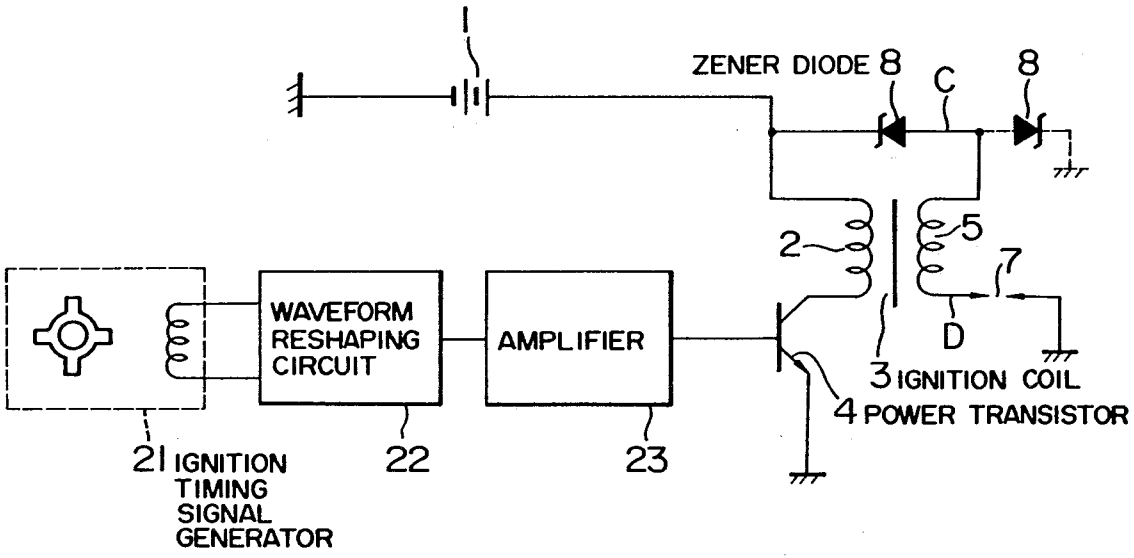
FIG. 1A is an electric circuit diagram showing an embodiment of an ignition system according to the present invention.
FIG. 1B shows an alternate embodiment of the system shown in FIG. 1A.
Figure 1A:
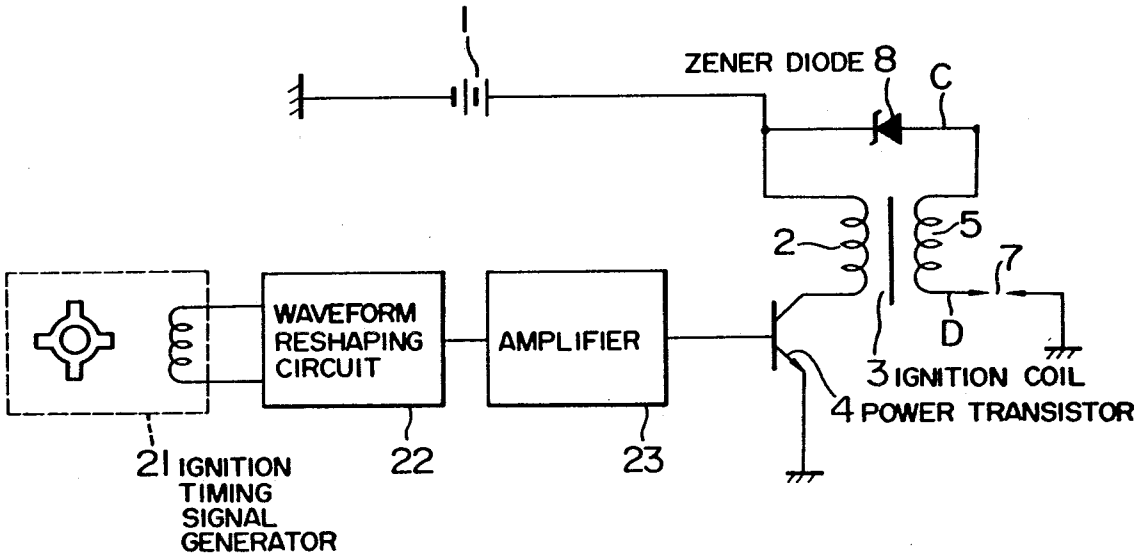

Referring to FIG. 1A, numeral 1 designates a battery of the negative-terminal grounding type, and 2 a primary winding of an ignition coil 3 having its one end connected to the positive terminal of the battery 1. Numeral 4 designates a power transistor forming switching means and having its collector connected to the other end of the primary winding 2 and its emitter grounded. Numeral 5 designates a secondary winding of the ignition coil 3 whose high voltage-side end is connected directly and not through a distributor to one end of a spark plug 7 whose other end is grounded. Numeral 8 designates a Zener diode having its anode connected to the low voltage-side end of the secondary winding 5 and its cathode connected to the end of the primary winding 2 which is on the positive terminal side of the battery 1.

Numeral 21 designates an ignition timing signal generator for generating an ignition timing signal in synchronism with the rotation of the engine, 22 a waveform reshaping circuit for changing the waveform of the ignition timing signal to a rectangular waveform, and 23 an amplifier circuit responsive to the rectangular waveform output from the waveform reshaping circuit 22 to turn on and off the power transistor 4.

With the construction described above, the advantages of this embodiment (or its advantageous features over the conventional type) will now be described.

(I) When the spark plug discharges (normal operation).

(a) The capacitive discharge current has no ill effect.

Figure 3A:
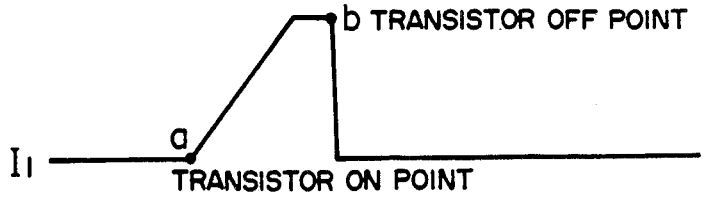
FIGS. 3A–3D shows a plurality of waveforms generated at various points in a conventional ignition system.
Figure 3B:
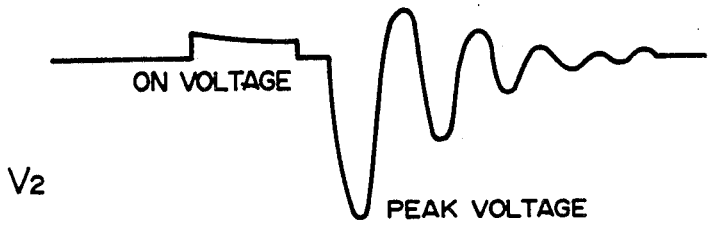
Figure 3C:
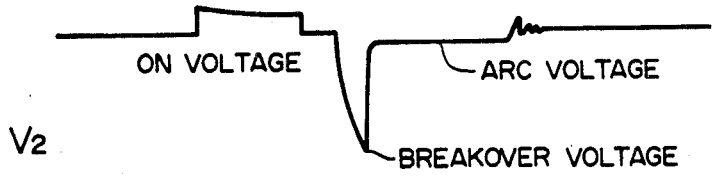
Figure 3D:
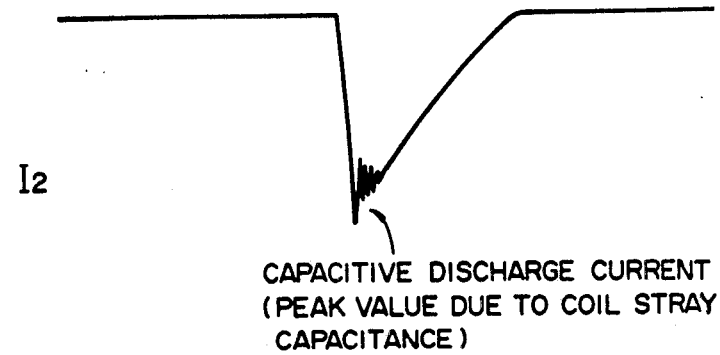
Figure 4:
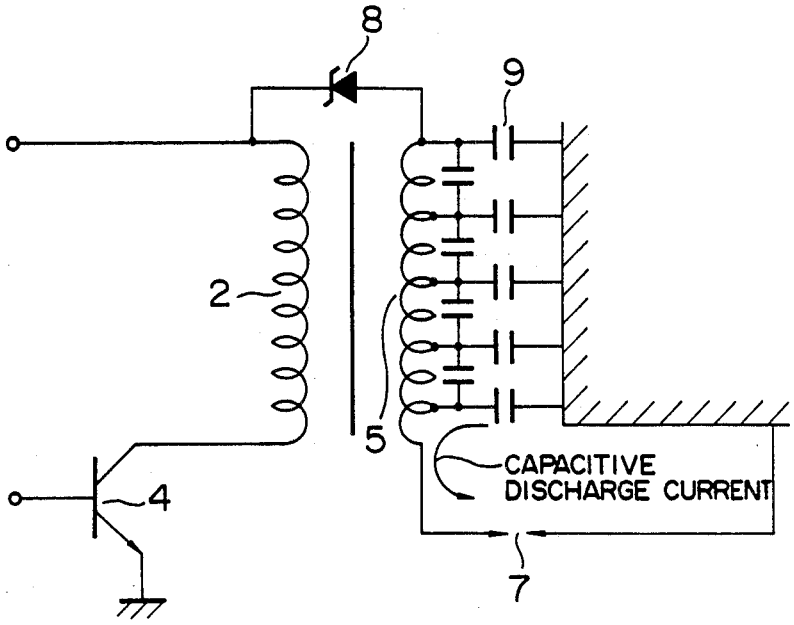
FIG. 4 shows an equivalent circuit diagram of a principal part of the system shown in FIG. 1.

In the conventional system, the high-voltage rectifier diode is loaded to generate heat by the capacitive discharge current shown in FIG. 3D, but there is practically no such ill effect on the Zener diode 8 in the embodiment. Usually, the capacitive discharge current is caused by the distributed capacitance in the ignition coil secondary winding and it becomes as shown in FIG. 4. (Here, while the secondary distributed capacitance primarily exists between the secondary winding and the primary winding or between the secondary winding and the core, it is equivalently represented as being present between the ground and the secondary winding in FIG. 4. However, the distributed capacitance between the windings is shown as such.) According to the equivalent circuit of FIG. 4, the capacitive discharge current does not flow through the Zener diode 8. (Because it is considered that the energy stored in capacitors 9 discharges through a closed loop through the capacitors, spark plug and the ground on the secondary winding side.)

(b) The diode is exposed to no high voltages.

In the conventional system, the waveform of a voltage produced by the discharge of the spark plug becomes as shown in FIG. 3C. Thus, the breakover voltage, the arc voltage and the ON voltage are always applied to the high-voltage rectifier diode. However, only the ON voltage is applied to the Zener diode 8 in the embodiment of FIG. 1A. This results in a considerable difference in the rate of deterioration between the Zener diode 8 and the conventional high-voltage rectifier diode.

(II) When the spark plug fails to cause spark discharge and is kept open (abnormal operation)

(a) The Zener diode load voltage is decreased by a decrease in the generated voltage.

Figure 2:
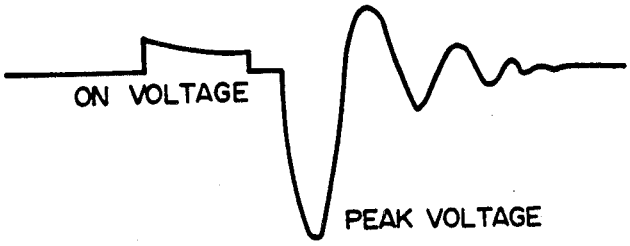
FIGS. 2A–2D shows a plurality of waveforms generated at various points in the system of FIG. 1 when the spark plug fails to cause a spark discharge.
Figure 2:
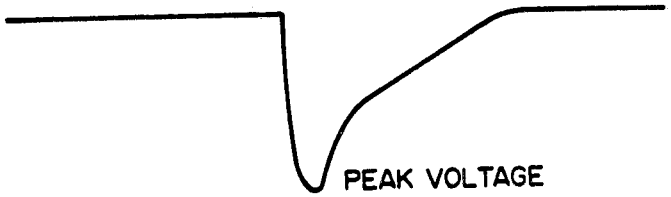
Figure 2:
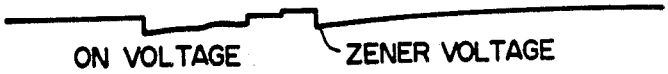
Figure 2:
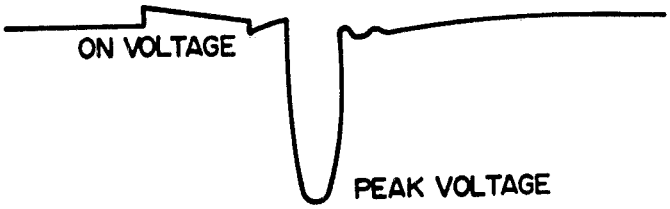

Shown in FIGS. 2A, 2B, 2C and 2D, respectively, are the voltage waveforms at the cathode and anode of the conventional high-voltage rectifier diode and the voltage waveforms at points C and D of FIG. 1A. The load voltage of the conventional high-voltage diode is shown in FIG. 2A. Also, at this time the ON voltage is practically equal to the difference between the ON voltages in FIGS. 2D and 2C. As a result, the resulting load voltage of the Zener diode 8 becomes about one half (about 1 KV) that of the conventional high-voltage diode.

(b) The prevention of system destroy by virtue of the Zener characteristc.

Although the conventional high-voltage rectifier diode also has a Zener characteristic, the reverse-blocking voltage is higher than the induced peak voltage and therefore the Zener characteristic is not utilized well. (if such a diode having a Zener voltage lower than the peak voltage is connected to the high voltage side of the secondary winding, the diode will be destroyed instantly.)

In FIG. 1A, however, when the voltage at the point C of FIG. 1A exceeds the Zener voltage as shown in FIG. 2C, a current flows in the reverse direction in Zener diode 8, and the voltage across the Zener diode 8 never exceeds the Zener voltage. As a result, it is only necessary that the Zener voltage of the Zener diode 8 of FIG. 1A has a value (2 to 4 KV) slightly higher than the generated ON voltage (1 to 3 KV). The conventional high-voltage rectifier diode for preventing the ON voltage will be destroyed immediately unless it is such a one that can also withstand the essential spark plug open voltage in the failure of causing the discharge (the current can flow nowhere even it is intended to do so). In contrast it has been confirmed that, even with the Zener diode 8 having a Zener characteristic of several volts and connected to the secondary low voltage side of the ignition coil 3 as in FIG. 1A, such a Zener diode is not destroyed although a current flows when the Zener voltage is exceeded. (However, the ON voltage cannot be blocked thus causing a spark discharge of the spark plug due to the ON voltage, thus the Zener characteristic of 2 to 4 KV is preferred for blocking the ON voltage).

Figure 1B:
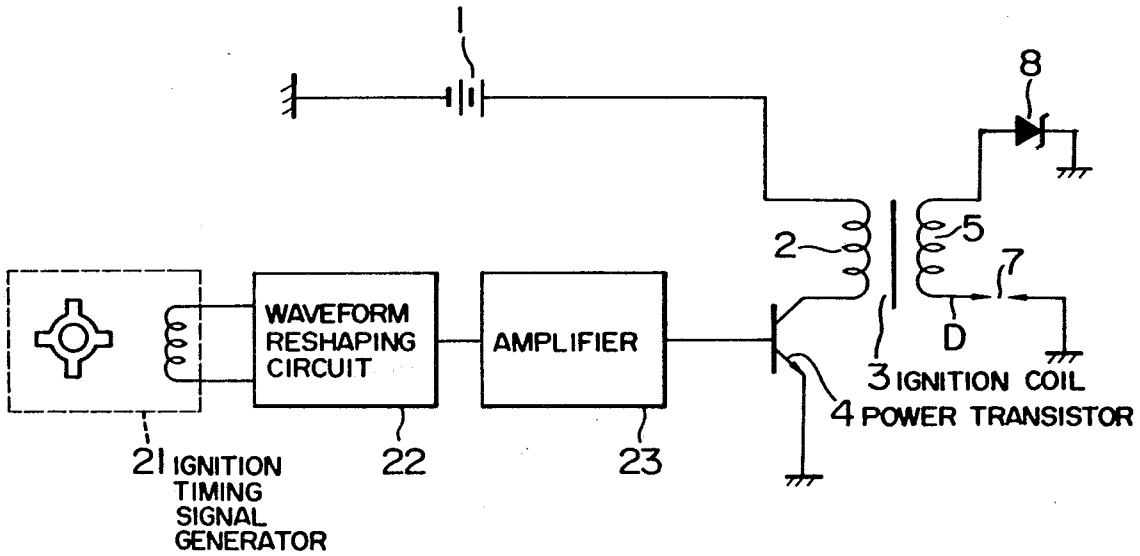

It is to be noted that while the Zener diode 8 shown in FIG. 1A has its cathode connected to the positive terminal of the battery 1, it may be connected to the ground or the like if it is of lower voltage level as shown in FIG. 1B. Also, while the spark plug 7 discharges with its ungrounded electrode of negative polarity in FIG. 1A, if the spark plug 7 is adapted to discharge with its ungrounded electrode of positive polarity, it is only necessary to reverse the connection of the Zener diode 8.

Figure 5A:
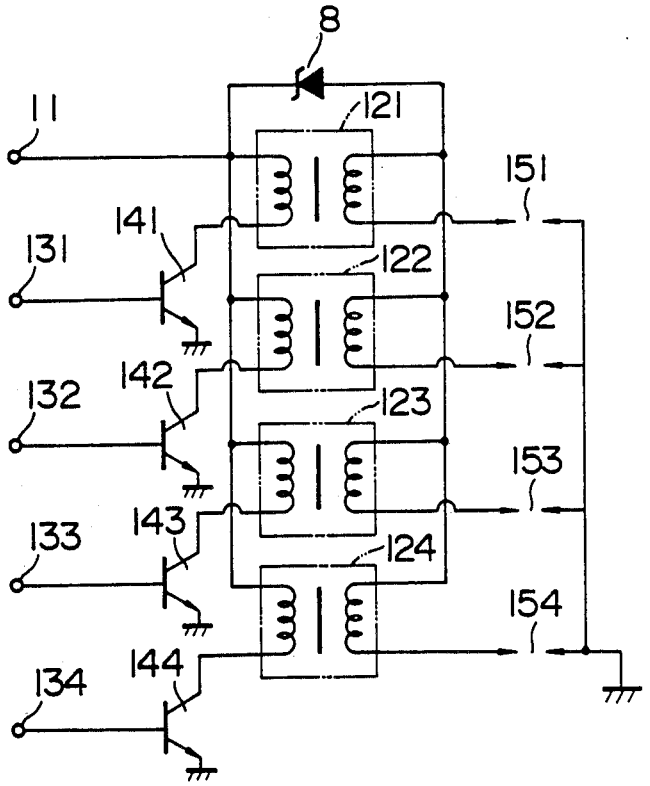
FIG. 5A is an electric circuit diagram showing a principal part of another embodiment of the system according to the invention.
Figure 5B:
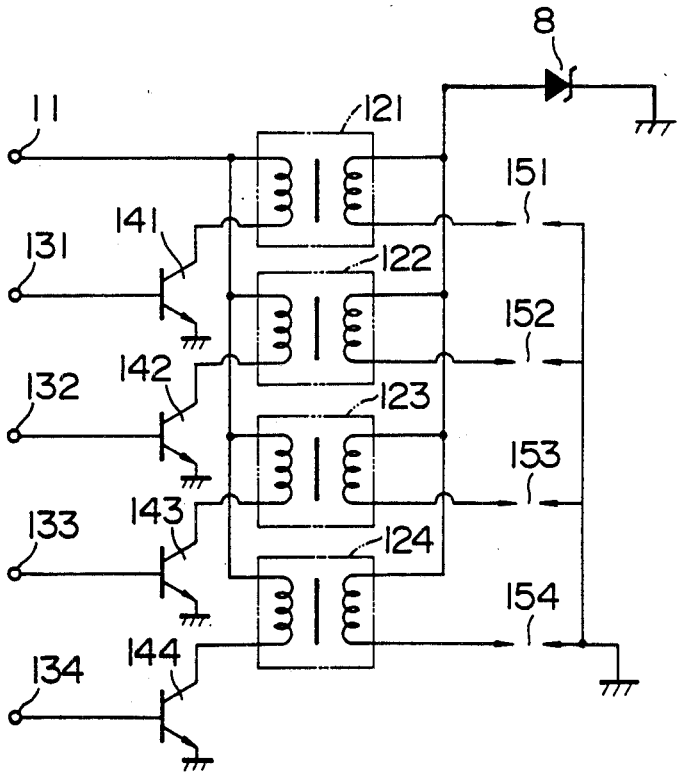
FIG. 5B shows an alternate embodiment of the FIG. 5A system.

This invention is particularly effective in an ignition system of the type having a single spark plug per each ignition coil to fire plural cylinders individually and such construction as shown in FIG. 5A will be advantageous if its use with a four-cylinder engine is considered. In this construction, the battery voltage from a battery terminal 11 charges ignition coils 121 to 124 for the respective spark plugs 151 to 154 and transistors 141 to 144 are respectively turned on and off in response to the respective input control signals from input control signal terminals 131 to 134 thereby producing a spark at each of the spark plugs 151 to 154. This circuit features that as compared with a construction in which four of the circuit of FIG. 1A are arranged, it is equivalent to one in which the four Zener diodes 8 are reduced to one and this results in a reduced cost. This circuit construction is applicable to the individual cylinder firing system involving any number of cylinders. FIG. 5B shows this embodiment as used with a lower voltage potential.

From the foregoing description, it will be seen that the present invention has a great effect in that although there is the occurrence of an ON voltage of about one half the conventional one, the provision of a Zener diode has the effect of blocking the flow of a current and thereby eliminating the danger of any spark discharge of the spark plug due to the ON voltage.

While it is liable to consider that the withstand voltage of the conventional type high-voltage rectifier diode during the spark plug discharge is just practical even if it is of the order just sufficient to block the ON voltage, its load current due to a capacitive discharge current cannot be disregarded. Also, when the spark plug fails to discharge, an excessive load is applied and the high-voltage rectifier diode would be destroyed. On the contrary, the present invention has a great effect that the Zener characteristic of a Zener diode prevents it from being destroyed even if any voltage is applied to it.

We claim:

1. an ignition system having an ignition coil with a secondary winding which operates one single spark plug that generates an ignition spark for an internal combustion engine in synchronism with rotation of said engine, said system further comprising:

(a) switching means for opening and closing in synchronism with the rotation of said engine;

(b) said ignition coil having a primary winding connected to said switching means and said secondary winding being connected only at a first, high voltage end thereof to said one spark plug, whereby said secondary winding is connected to operate only a single spark plug, and whereby a current unindirectionally flows to said primary winding to store an ignition energy therein in response to closing of said switching means and the current flowing to said primary winding is interrupted in response to opening of said switching means thereby inducing a high voltage in said secondary winding; and (c) reverse current blocking means connected to a low voltage, second end of said secondary winding, opposite to said first end to which said one spark plug is connected, for preventing a voltage induced in said secondary winding in response to closing of said switching means from being supplied to said spark plug.

2. A system according to claim 1, wherein said reverse current blocking means comprises a Zener diode having a Zener voltage higher than the voltage induced at the low voltage side of said secondary winding in response to closing of said switching means.

3. A system according to claim 2, wherein the Zener voltage of said Zener diode is preset to 2 to 4 KV.

4. A system according to claim 1, wherein said low voltage end of said secondary winding is grounded through said reverse blocking means.

5. A distributorless ignition system for an internal combustion engine wherein an ignition spark is generated at each of a plurality of spark plugs each arranged in one of a plurality of cylinders of said engine in synchronism with rotation thereof, said system comprising:

(a) a plurality of switching means sequentially operable to open and close in synchronism with the rotation of said engine;

(b) a plurality of ignition coils, each of said ignition coils having a primary winding connected to one of said switching means and a secondary winding connected at one end thereof to one of said spark plugs whereby a current flows to said primary winding to store an ignition energy therein in response to closing of said one switching means and the current flowing to said primary winding is interrupted in response to opening of said one switching means thereby inducing a high voltage in said secondary winding; and (c) common reverse current blocking means connected in common to a low voltage side of each of said secondary windings opposite to one of said spark plugs whereby a voltage induced in each said secondary winding in response to closing of one of said switching means is prevented from being supplied to said one spark plug.

6. A system according to claim 5, wherein said reverse current blocking means comprises a Zener diode having a Zener voltage higher than the voltage induced at the low voltage side of each of said secondary windings in response to the closing of said one switching means.

7. An ignition system for an internal combustion engine having at least one spark plug which generates an ignition spark in synchronism with a rotation of said engine, said system comprising:

(a) switching means for opening and closing in synchronism with the rotation of said engine;

(b) an ignition coil having a primary winding connected to said switching means and a secondary winding, having a high voltage end thereof coupled to said spark plug, and another end whereby a current flows to said primary winding to store an ignition energy therein in response to closing of said switching means and the current flowing to said primary winding is interrupted in response to opeining of said switching means thereby including a high voltage in said secondary winding; and (c) reverse current blocking means connected between said another end of said secondary winding and to one end of said primary winding, for preventing a voltage induced in said secondary winding in response to closing of said switching means from being supplied to said spark plug.

8. A system according to claim 7, wherein said reverse current blocking means comprises a Zener diode having a Zener voltage higher than the voltage induced at the low voltage side of said secondary winding in response to closing of said switching means.

9. A system according to claim 7, wherein the Zener voltage of said Zener diode is preset to 2 to 4 KV.

* * * * *